United States Patent [19]

Itsuji et al.

[11] Patent Number: 4,676,213

[45] Date of Patent: Jun. 30, 1987

[54] ENGINE AIR-FUEL RATIO CONTROL APPARATUS

[75] Inventors: Takayuki Itsuji; Sadayasu Ueno, both of Katsuta, Japan

[73] Assignees: Hitachi, Ltd., Tokyo; Hitachi Automotive Engineering Co., Ltd., Katsuta, both of Japan

[21] Appl. No.: 911,784

[22] Filed: Sep. 26, 1986

[30] Foreign Application Priority Data

Oct. 2, 1985 [JP] Japan ..... 60-217888

[51] Int. Cl.[4] ..... F02B 3/00

[52] U.S. Cl. ..... 123/440; 123/489

[58] Field of Search ..... 123/489, 440; 60/276; 204/404, 424, 425, 426

[56] References Cited

U.S. PATENT DOCUMENTS

| | | | |
|---|---|---|---|
| 4,502,444 | 3/1985 | Rubbo | 123/489 |
| 4,534,330 | 8/1985 | Osuga | 123/440 |
| 4,545,351 | 10/1985 | Andrew | 123/440 |
| 4,624,232 | 11/1986 | Saito | 123/440 |

*Primary Examiner*—Ronald B. Cox

*Attorney, Agent, or Firm*—Antonelli, Terry & Wands

[57] ABSTRACT

An air-fuel ratio control apparatus is disclosed in which an air-fuel ratio sensor disposed in the exhaust system of an internal combustion engine produces a voltage signal correlated with the excess air ratio of the ambient gas surrounding it and has such an output characteristic as to produce a maximum output only when the ambient gas is filled with air, the air-fuel ratio of the internal combustion engine being controlled to a proper value on the basis of the detection signal of the air-fuel ratio sensor. The air-fuel ratio control apparatus further comprises a sampling device for sampling the maximum output ($V_x$) when it is decided that the output of the air-fuel ratio sensor is maintained for a predetermined length of time or longer at a predetermined value or higher, a memory for storing the sample value of the maximum output ($V_x$) produced by the sampling device and updating the preceding sample value ($V_{x-1}$) to the present sample value ($V_x$) when a new maximum output is sampled each time of the decision, and a calibrator for calibrating the output characteristic of the air-fuel ratio sensor on the basis of the latest updated sample value ($V_x$).

11 Claims, 15 Drawing Figures

ENGINE AIR-FUEL RATIO CONTROL APPARATUS

BACKGROUND OF THE INVENTION

The present invention relates to an air-fuel ratio control apparatus for an internal combustion engine using a microcomputer, or more in particular to an air-fuel ratio control apparatus comprising means for compensating for the secular variations caused by contamination of an air-fuel ratio sensor or the like.

In conventional engine control systems using a microcomputer, data representing the engine operating conditions are collected by use of various sensors, an amount of a basic fuel supply is determined from these data, and the operation of the carburetor or the fuel injector is controlled through an actuator. Most of the engine control systems of this type comprises an air-fuel ratio control apparatus for operating the engine at a proper air-fuel ratio in order to improve fuel consumption rate and satisfy the exhaust gas control requirements.

The air-fuel ratio control apparatus specifically comprises an air-fuel ratio sensor represented by an oxygen sensor for accurate detection of the mixing ratio (air-fuel ratio) of the fuel and air supplied to the internal combustion engine, so that the air-fuel ratio is controlled to a proper value by a closed loop in response to an output of the air-fuel ratio sensor.

The air-fuel ratio sensor, however, which is mounted in the exhaust system of the internal combustion engine, is unavoidably contaminated with time by the exhaust gas after long engine operation. The detection accuracy of a contaminated air-fuel ratio sensor is deteriorated, thereby making it impossible to control the air-fuel ratio satisfactorily.

Conventionally, as disclosed in JP-A-58-57050, the atmospheric air is used as a known reference air-fuel ratio for calibrating the secular variations in the output characteristics of the air-fuel ratio sensor.

Specifically, in view of the fact that the output of the air-fuel ratio sensor reaches the maximum when the surroundings thereof are filled with the atmospheric air, the output value of the sensor which is surrounded by the atmospheric air and not yet contaminated in the initial stage of engine operation is used as a reference value. The output value of the sensor being contaminated by the usage of the engine is read when the sensor is surrounded by the atmospheric air. From the ratio between these two values, the compensation factor of the output characteristics of the air-fuel ratio sensor is calculated. The factor is multiplied with the output of the air-fuel ratio sensor thereby to obtain a correct output value of the air-fuel ratio sensor.

Whether the air-fuel ratio sensor is surrounded by the atmospheric air is determined by detecting whether the engine is in a fuel cut state such as a deceleration state or a non-started state or not. Specifically, when the engine is in a deceleration state, for example, if the throttle valve is closed and the engine speed is reduced below a predetermined level, it is decided that fuel has been cut, and assuming that the surroundings of the air-fuel ratio sensor is filled with the atmospheric air upon a lapse of a predetermined length of time later after the decision. Thus, the output value of the air-fuel ratio sensor after the lapse of the predetermined time is read thereby to calculate the above-mentioned compensation factor.

Depending on the operating conditions before deceleration, however, even after the lapse of the above-mentioned predetermined length of time, fuel may remain attached on the interior of the intake manifold or the mixture gas may exist in the exhaust port, with the result that the output value of the air-fuel ratio sensor may not represent a value when the surroundings of the air-fuel ratio sensor are filled with the atmospheric air. Therefore, the desired maximum value of the air-fuel ratio may not be obtained. If the output characteristics of the air-fuel ratio sensor are calibrated on the basis of this inaccurate output maximum value thereof, the air-fuel ratio is not controlled properly. One method of preventing this inaccurate detection of the maximum value of the output of the air-fuel ratio sensor is to set the above-mentioned predetermined time sufficiently long. Nevertheless, if the predetermined time is excessively long, the maximum output value of the air-fuel ratio sensor is less likely to be detected under the above-mentioned conditions, and therefore there are fewer chances of calibrating the output characteristics. Thus, it makes it difficult to detect the output of the air-fuel ratio sensor accurately.

Before the engine is started, on the other hand, when the ignition switch is turned on but the engine speed is zero, it is decided that the exhaust port is filled with the atmospheric air, and the output of the air-fuel ratio sensor at this time is read. In the case where the ignition switch is turned on immediately after the engine stops, however, the exhaust gas or the like may still remain in the exhaust port and it is difficult to detect the maximum output value of the air-fuel ratio sensor, thus making accurate calibration of the output characteristics thereof impossible.

Further, since a lean sensor is used as the air-fuel ratio sensor in the conventional system, the closed loop control of the air-fuel ratio is impossible in the rich mixture region of the air-fuel ratio.

SUMMARY OF THE INVENTION

An object of the present invention is to obviate the above-mentioned disadvantages of the conventional systems and to provide an air-fuel ratio (A/F) control apparatus in which the secular variations in the output characteristics of an air-fuel ratio sensor are capable of being accurately calibrated.

In order to achieve this object, according to the present invention, there is provided an air-fuel ratio control apparatus comprising an air-fuel ratio sensor disposed in the exhaust system of the internal combustion engine for producing a voltage signal correlated with the excess rate of the surrounding air and having such an output characteristic that the maximum output is produced only when the ambience is filled only with air, the air-fuel ratio of the internal combustion engine being controlled to a proper value in accordance with a detection signal of the air-fuel ratio sensor, wherein the air-fuel ratio control apparatus further comprises sampling means for sampling the maximum output (Ex(max)) when it is decided that the output of the air-fuel ratio sensor is maintained above a predetermined value for a predetermined length of time or longer, memory means for storing the sample value (Ex(max)) of the maximum output of the sampling means and for updating the previous sample value (Ex-1(max)) to the present sample value (Ex(max)) each time of sampling the maximum output upon each of said decision, and calibration means for calibrating the output characteristics of the air-fuel ratio sensor by the updated sample value (Ex(-max)).

In the apparatus according to the present invention having a configuration mentioned above, the fact is utilized that the air-fuel ratio sensor produces a maximum output when the surrounding of the air-fuel ratio sensor is filled with the atmospheric air and that this maximum output varies with time due to the contamination or the like of the air-fuel ratio sensor. According to the present invention, to the extent that the output of the air-fuel ratio sensor is maintained at higher than a predetermined value for at least a predetermined length of time, it is decided that the surroundings of the air-fuel ratio sensor have been filled with the atmospheric air, and the prevailing maximum output (Ex(max)) is sampled. This sampling operation always follows the progress of contamination of the air-fuel ratio sensor since the timing of sampling coincides with the production of a maximum output (Ex(max)). This sample value is updated and stored each time of the above decisions, that is, each time of sampling of maximum output value, so that it is possible to calibrate the output characteristics of the air-fuel ratio sensor by use of a new maximum sample value (Ex(max)) in place of the preceding maximum sample value (Ex-1(max)). In this process of calibration, the air-fuel ratio value produced from the air-fuel ratio sensor is corrected in accordance with the change in the maximum output value.

In this way, it is decided whether the exhaust port is filled with the atmospheric air or not by directly reading the output value of the air-fuel ratio sensor, and therefore the output of the air-fuel ratio sensor in a state where the exhaust port is filled with the atmospheric air can be detected. Thus, accurate calibration of the output characteristics of the air-fuel ratio sensor can be performed.

DESCRIPTION OF THE PREFERRED EMBODIMENTS

Now, an embodiment of the air-fuel ratio control apparatus according to the present invention will be explained below with reference to the accompanying drawings.

First, FIGS. 1 to 4 show an engine control system with an air-fuel ratio control apparatus according to the present invention as applied to a fuel injection system thereof.

Figure 1:
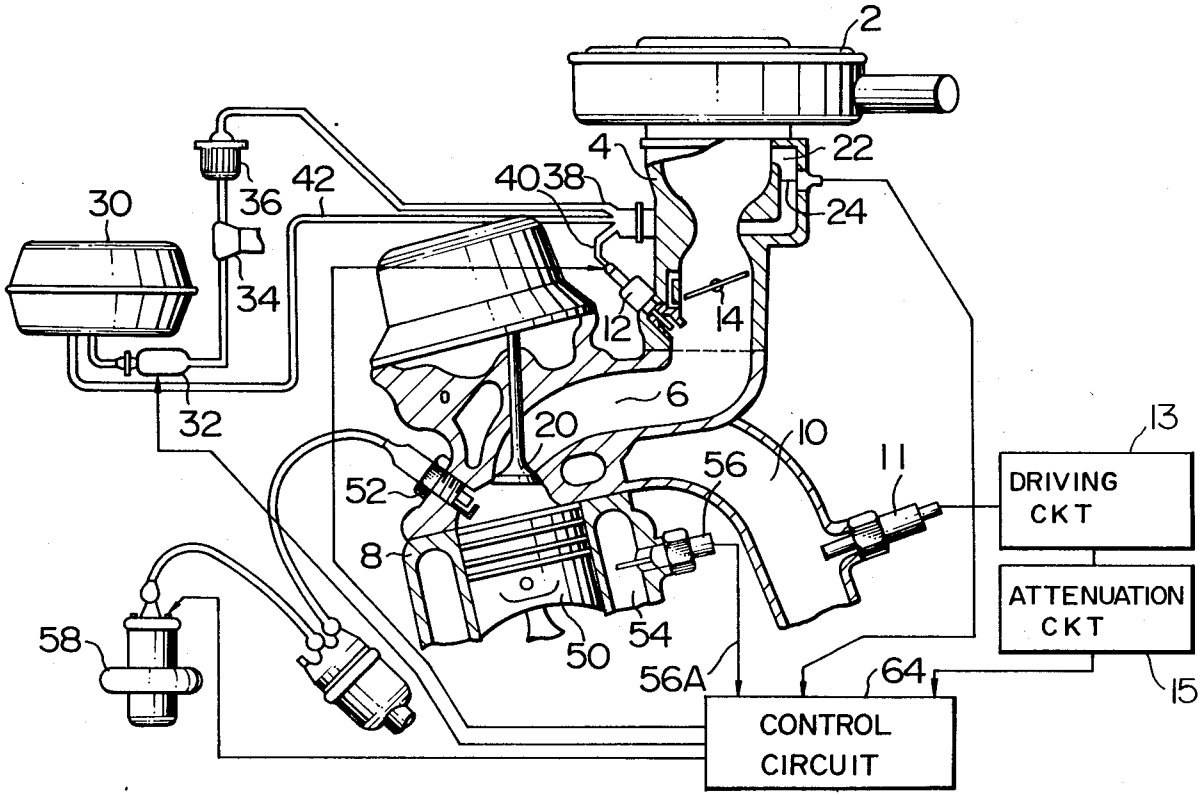
FIG. 1 shows a whole arrangement of a fuel injection-type engine control system.

A control system of the whole engine system is shown in FIG. 1.

In FIG. 1, suction air is supplied to a cylinder 8 through an air cleaner 2, a throttle chamber 4, and a suction pipe 6. A gas burnt in a cylinder 8 is discharged from the cylinder 8 to the atmosphere through an exhaust pipe 10. An injector 12 for injecting fuel is provided in the throttle chamber 4. The fuel injected from the injector 12 is atomized in an air path of the throttle chamber 4 and mixed with the suction air to form a fuel-air mixture which is in turn supplied to a combustion chamber of the cylinder 8 through the suction pipe 6 when a suction valve 20 is opened. An air-fuel ratio sensor 11 is provided in the exhaust pipe 10 for detecting an air-fuel ratio of the gas in the exhaust pipe 10.

Throttle valve 14 is provided in the vicinity of the output of the injector 12. The throttle valve 14 is arranged so as to mechanically interlocked with an accelerator pedal (not shown) so as to be driven by the driver.

An air path 22 is provided at the upper stream of the throttle valve 14 of the throttle chamber 4 and an electrical heater 24 constituting a thermal air flow rate meter is provided in the air path 22 so as to derive from the heater 24 and electric signal which changes in accordance with the air flow velocity which is determined by the relation between the air flow velocity and the amount of heat transmission of the heater 24. Being provided in the air path 22, the heater 24 is protected from the high temperature gas generated in the period of back fire of the cylinder 8 as well as from the pollution by dust or the like in the suction air. The outlet of the air path 22 is opened in the vicinity of the narrowest portion of the venturi and the inlet of the same is opened at the upper stream of the venturi.

Figure 4:
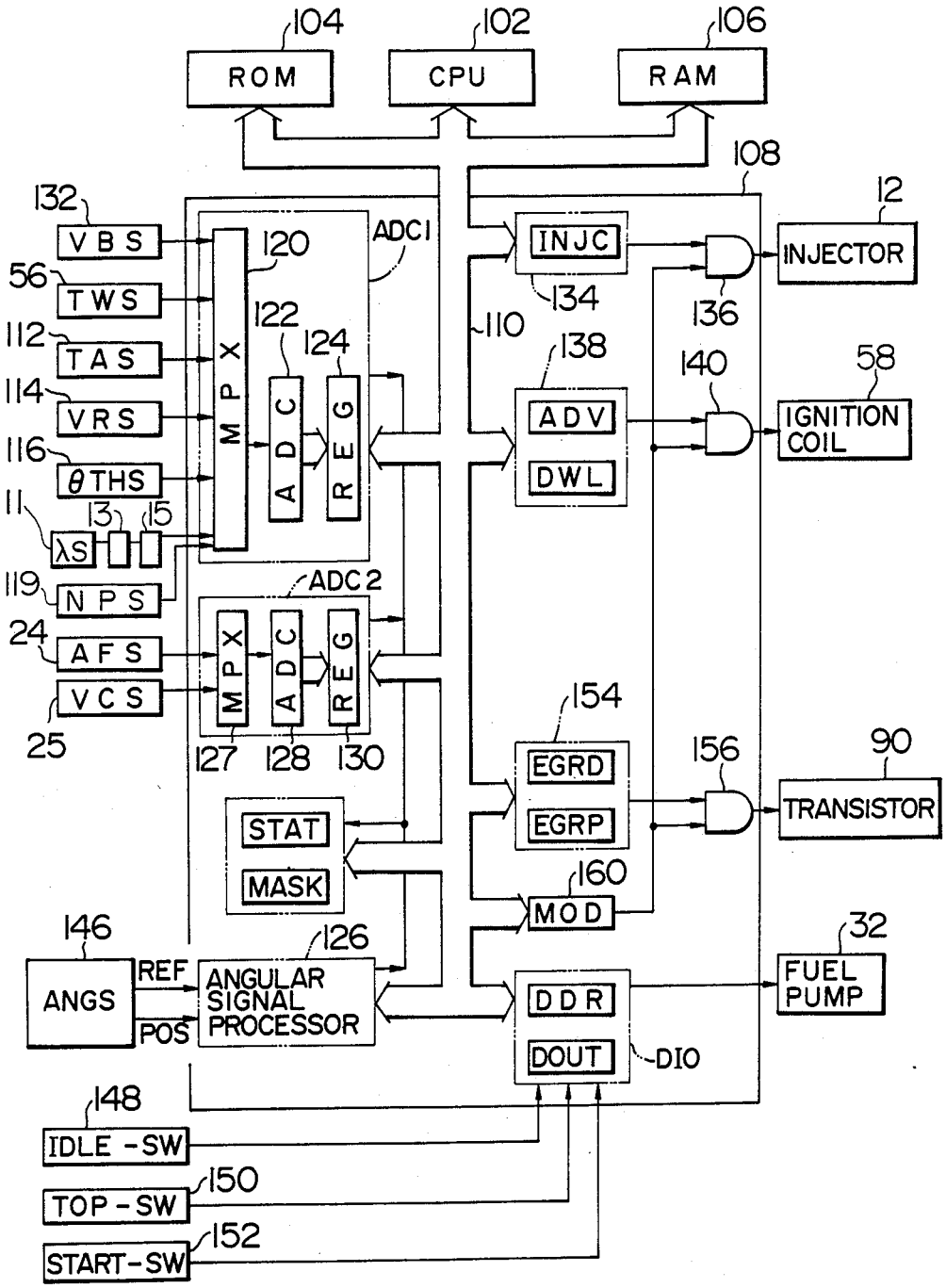
FIG. 4 shows a whole arrangement of fuel injection-type engine control system.

Throttle opening sensors (not shown in FIG. 1 but generally represented by a throttle opening sensor 116 in FIG. 4) are respectively provided in the throttle valve 14 for detecting the opening thereof and the detection signals from these throttle opening sensors, that is the sensor 116, are taken into a multiplexer 120 of a first analog-to-digital converter as shown in FIG. 4.

The fuel to be supplied to the injector 12 is first supplied to a fuel pressure regulator 38 from a fuel tank 30 through a fuel pump 32, a fuel damper 34, and a filter 36. Pressurized fuel is supplied from the fuel pressure regulator 38 to the injector 12 through a pipe 40 on one hand and fuel is returned on the other hand from the fuel pressure regulator 38 to the fuel tank 30 through a return pipe 42 so as to maintain constant the difference between the pressure in the suction pipe 6 into which fuel is injected from the injector 12 and the pressure of the fuel supplied to the injector 12.

The fuel-air mixture sucked through the suction valve 20 is compressed by a piston 50, burnt by a spark produced by an ignition plug 52, and the combustion is converted into kinetic energy. The cylinder 8 is cooled by cooling water 54, the temperature of the cooling water is measured by a water temperature sensor 56, and the measured value is utilized as an engine temperature. A high voltage is applied from an ignition coil 58 to the ignition plug 52 in agreement with the ignition timing.

A crank angle sensor (not shown) for producing a reference angle signal at a regular interval of predetermined crank angles (for example 180 degrees) and a position signal at a regular interval of a predetermined unit crank angle (for example 0.5 degree) in accordance with the rotation of engine, is provided on a not-shown crank shaft.

The output of the crank angle sensor, the output of the water temperature sensor 56, and the electrical signal from the heater 24 are inputted into a control circuit 64 constituted by a microcomputer or the like so that the injector 12 and the ignition coil 58 are driven by the output of this control circuit 64.

Figure 2:
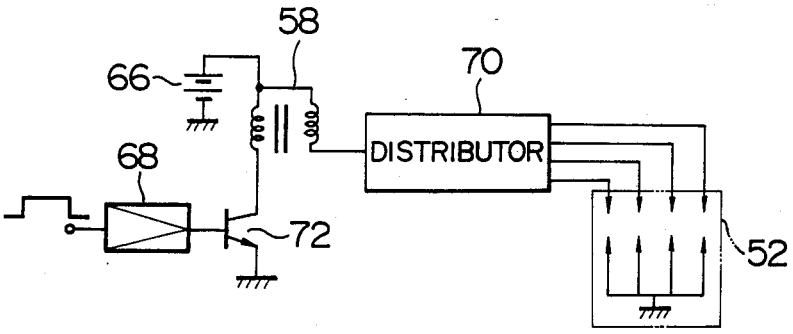
FIG. 2 shows an ignition system of the arrangement of FIG. 1.

In FIG. 2, which is an explanatory diagram of the ignition device of FIG. 1, a pulse current is supplied to a power transistor 72 through an amplifier 68 to energize this transistor 72 so that a primary coil pulse current flows into an ignition coil 58 from a battery 66. At the trailing edge of this pulse current, the transistor 74 is turned off so as to generate a high voltage at the secondary coil of the ignition coil 58.

This high voltage is distributed through a distributor 70 to ignition plugs 52 provided at the respective cylinders in the engine, in synchronism with the rotation of the engine.

Figure 3:
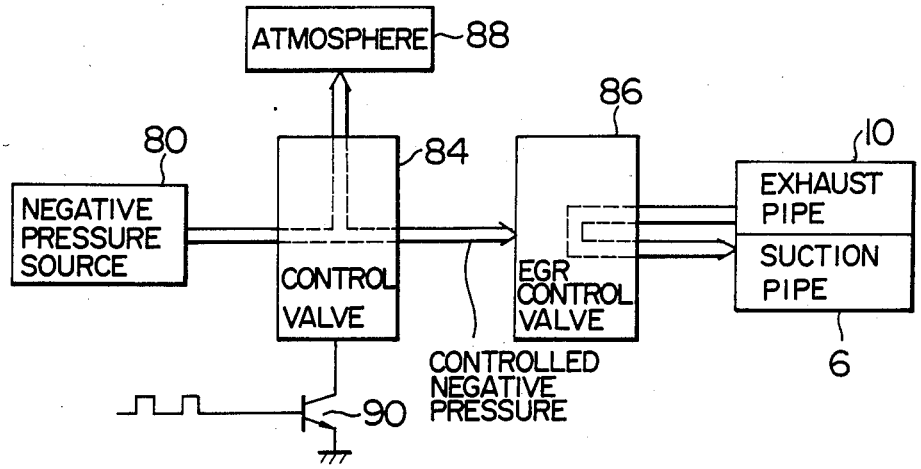
FIG. 3 shows an exhaust gas circulating system.

In FIG. 3, which is an explanatory diagram of an exhaust gas reflux (hereinafter abbreviated as EGR) system, a predetermined negative pressure of a negative pressure source 80 is applied to an EGR control valve 86 through a pressure control valve 84. The pressure control valve 84 controls the ratio with which the predetermined negative pressure of the negative pressure source is released to the atmosphere 88, in response to the ON duty factor of the repetitive pulse applied to a transistor 90, so as to control the state of application of the negative pressure pulse to the EGR control valve 86. Accordingly, the negative pressure applied to the EGR control valve 86 is determined by the ON duty factor of the transistor 90 per se. The amount of EGR from the exhaust pipe 10 to the suction pipe 6 is controlled by the controlled negative pressure of the pressure control valve 84.

FIG. 4 is a diagram showing the whole configuration of the control system 64 which is constituted by a central processing unit (hereinafter abbreviated as CPU) 102, a read only memory (hereinafter abbreviated as a ROM) 104, a random access memory (hereinafter abbreviated as RAM) 106, and an input/output (hereinafter abbreviated as I/O) circuit 108. The CPU 102 operates input data from the I/O circuit 108 in accordance with various programs stored in the ROM 104 and returns the result of operation to the I/O circuit 108. Temporary data storage necessary for such an operation is performed by using the RAM 106. Exchange of various data among the CPU 102, the ROM 104, the RAM 106, and the I/O circuit 108 is performed through a bus line 110 constituted by a data bus, a control bus, and an address bus.

The I/O circuit 108 includes input means such as the above-mentioned first analog-to-digital converter (hereinafter abbreviated as ADC1), a second analog-to-digital converter (hereinafter abbreviated as ADC2), an angular signal processing circuit 126, and a discrete I/O circuit (hereinafter abbreviated as DIO) for inputting/outputting one bit information.

In the ADC1, the respective output signals of a battery voltage sensor (hereinafter abbreviated as VBS) 132, the above-mentioned cooling water temperature sensor (hereinafter abbreviated as TWS) 56, an atmosphere temperature sensor (hereinafter abbreviated as TAS) 112, a regulation voltage generator (hereinafter abbreviated as VRS) 114, above-mentioned throttle opening sensor (hereinafter referred to as $\theta$THS) 116, and an air-fuel ratio sensor (hereinafter abbreviated as $\lambda$S or A/F sensor) 11 are applied to the above-mentioned multiplexer (hereinafter abbreviated as MPX) 120 which selects one of the respective input signals and outputs the selected signal to an analog-to-digital converter circuit (hereinafter abbreviated as ADC) 122. The digital value of the output of the ADC 122 is stored in a register (hereinafter abbreviated as REG) 124.

Output signals of the air flow rate sensor (hereinafter abbreviated as AFS) 24 and a vacuum sensor (hereinafter abbreviated as VCS) 25 are inputted to the ADC2 in which the signals are applied to a multiplexer 127 and then A/D converted in an ADC 128 and set in a REG 130.

An angle sensor (hereinafter abbreviated as ANGS) 146 produces a reference signal representing a reference crank angle (hereinafter abbreviated as REF), for example as a signal generated at an interval of 180 degrees of crank angle, and a position signal representing a small crank angle (hereinafter abbreviated as POS), for example 1 (one) degree. The REF and POS are applied to the angular signal processing circuit 126 to be wave-form-shaped therein.

The respective output signals of an idle switch 148 (hereinafter abbreviated as IDLE-SW) 148, a top gear switch (hereinafter abbreviated as TOP-SW) 150, and a starter switch 152 (hereinafter abbreviated as START-SW) are inputted into the DIO.

Next, a circuit for outputting pulses in accordance with the result of operation of the CPU 102 and an object to be controlled will be described hereunder. An injector circuit (hereinafter abbreviated as INJC) 134 is provided for converting the digital value of the result of operation into a pulse output. Accordingly, a pulse having a pulse width corresponding to the period of fuel injection is generated in the INJC 134 and applied to the injector 12 through an AND gate 136.

An ignition pulse generating circuit (hereinafter abbreviated as IGNC) 138 includes a register (hereinafter referred to as ADV) for setting ignition timing and another register (hereinafter referred to as DWL) for setting initiating timing of the primary current conduction of the ignition coil 58 and these data are set by the CPU 102. The ignition pulse generating circuit 138 produces a pulse on the basis of the thus set data and supplies this pulse through an AND gate 140 to the amplifier 68 described in detail with respect to FIG. 2.

An EGR amount controlling pulse generating circuit (hereinafter abbreviated as EGRC) 154 for controlling the transistor 90 which controls the EGR control valve 86 as shown in FIG. 3, has a register EGRD for setting a value representing the duty factor of the pulse and another register EGRP for setting a value representing the repetitive period of the pulse. The output pulse of the EGRC 154 is applied to the transistor 90 through an AND gate 156.

The one-bit I/O signals are controlled by the circuit DIO. The I/O signals include the respective output signals of the IDLE-SW 148, the TOP-SW 150 and the START-SW 152 as input signals, and include a pulse signal for controlling the fuel pump 32 as an output signal. The DIO includes a register DDR for determining whether a terminal be used as a data inputting one or a data outputting one, and another register DOUT for latching the output data.

A register (hereinafter referred to as MOD) 160 is provided for holding commands instructing various internal states of the I/O circuit 108 and arranged such that, for example, all the AND gates 136, 140, 144, and 156 are turned on/off by setting a command into the NOD 160. The stoppage/start of the respective outputs of the INJC 134, IGNC 138, and ISCC 142 can be thus controlled by setting a command into the MOD 160.

Before describing the embodiments of the present invention, the constructions and operation of the A/F sensor 11 will be described hereunder with reference to FIGS. 5–8.

Figure 6:
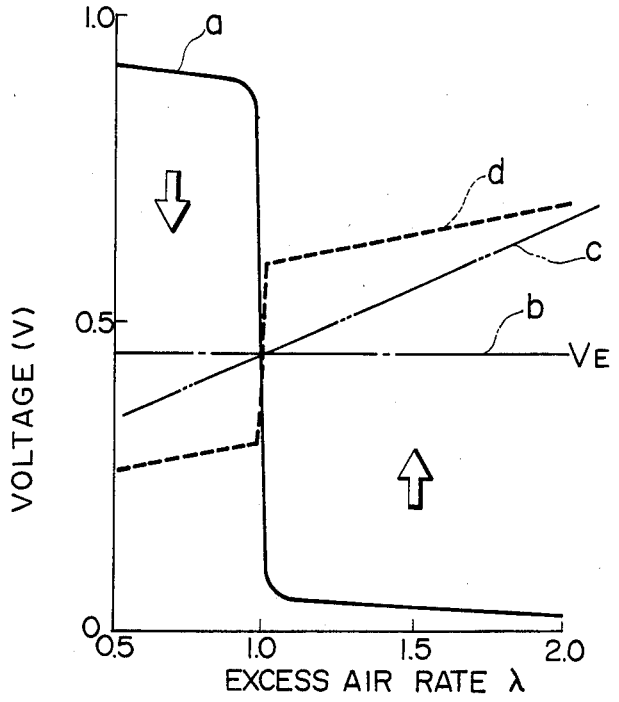
FIG. 6 shows characteristics of the A/F sensor.

A predetermined voltage $V_E$ (for instance 0.45 V) is applied between an electrode on the atmosphere side and an electrode on the exhaust side regardless of an excess air rate λ such as shown by an exciting voltage characteristic (b) in FIG. 6 against a characteristic of a curve (a) which changes incrementally at the theoretical A/F (λ=1). With this applied voltage, an electromotive force of the curve (a) is decreased in a rich region (λ<1) and is increased in a lean region (λ>1). The voltage $V_E$ can be applied with a predetermined inclination as shown by characteristic (c) or incrementally as shown by characteristic (b).

Figure 5:
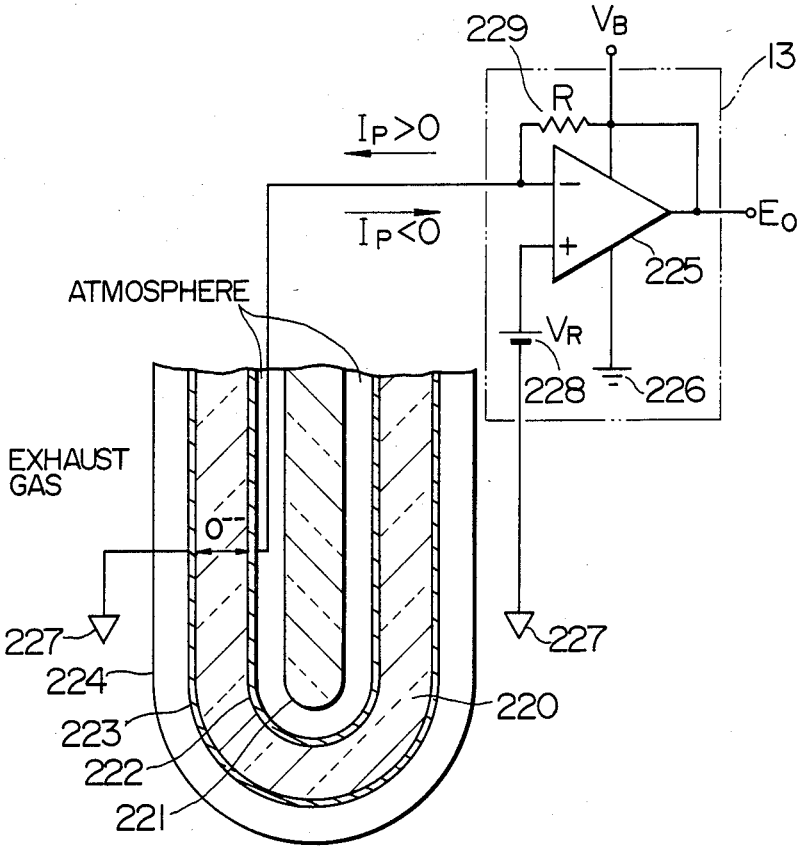
FIG. 5 shows a principal constitution of an A/F sensor.

FIG. 5 shows a principle constitution of the A/F sensor. The sensor of FIG. 5 is constituted by a detecting part of oxygen constituency and a driving circuit 13 which drives the detecting part. The reference numeral 220 denotes a tubular zirconia solid electrolyte and the atmospheric air is introduced into the electrolyte 220. The reference numeral 221 denotes a rod-shaped heater which heats the zirconia solid electrolyte 220 to at least 600° C. to improve conductiveness of oxygen ions. A first electrode 222 is formed on the atmosphere side of the zirconia solid electrolyte 220 and a second electrode 223 is formed on the exhaust side of the zirconia solid electrolyte 220. These electrodes are composed of platinum with thickness of several tens of μm and made porous. A diffusion-resistant body 224 is formed on the surface of the second electrode 223 to suppress gases such as oxygen or carbon monoxide which flow from the exhaust gas atmosphere into the electrode 223 part by diffusion. The diffusion-resistant body 224 is formed by plasma spray from a spinner or the like and made porous. In order to make diffusion resistance rate large, the thickness of the diffusion resistant body 224 is several hundreds of μm and has a thickness several times that of the film in a theoretical A/F sensor. The detecting part of the A/F sensor is constituted as described above.

The reference numeral 225 denotes a differential amplifier. The second electrode 223 is connected to a floating ground 227 which has a level higher by a certain voltage than a real ground 226. The first electrode 222 is connected to a (−) side input terminal of the amplifier 225. A voltage source 228 for predetermination of an exciting voltage $V_R$ is inserted between a (+) side input terminal of the amplifier 225 and the floating ground 227. A fixed resistor 229 of resistance R is provided for converting an oxygen pumping current Ip which represents the quantity of oxygen ions flowing through the zirconia solid electrolyte 220 into an output voltage $E_O$. The driving circuit 13 of the A/F sensor is constituted as described above.

The operation of the A/F sensor 11 is hereunder described.

As a potential of the second electrode 223 is lower than a potential of the first electrode 222 by $V_R$ in the lean region, oxygen molecules in the second electrode 223 part are converted into oxygen ions ($O^{--}$) in the electrode part by the exciting voltage $V_R$ and transferred to the first electrode 222 part through the zirconia solid electrolyte 220 by an operation of oxygen pump. Then the oxygen ions are again neutralized in the electrode part and discharged into the atmosphere. At that time, a positive pump current Ip (reverse direction to $O^{--}$flow) is applied in the circuit and the output voltage Eo is changed.

As the pumping current Ip, wherein IP>O, corresponds to the quantity of oxygen flowing from the exhaust gas atmosphere into the second electrode 223 part through the diffusion resistant body 224 by diffusion, the following equation is effected:

$$Ip=K(\lambda-1) \quad (1)$$

wherein λ is an excess air rate and K is a proportionality constant.

Therefore, if an electrical potential of the potential ground is $V_O$, as the output voltage $E_O$ of the A/F sensor is, $$E_O=V_R+V_O+IpR \quad (2)$$

when from equations (1) and (2), $$E_O=V_R+V_O+K(\lambda-1)R \quad (3),$$

At the theoretical A/F (λ=1), the ratio of the residual oxygen and the residual unburnt gas such as carbon monoxide in the exhaust gas flowing into the second electrode 223 part through the diffusion resistant body is the ratio of the chemical equivalents and both of them are completely burnt by catalysis of the second electrode. As the oxygen is eliminated in the second electrode 223 part, even if a voltage is applied between the first electrode 222 and the second electrode 223, no oxygen ion is transferred through the zirconia solid electrolyte 220. Therefore, the pumping current in the electronic circuit becomes zero (Ip=0).

At that time, from the equation (3), the output voltage Eo is, $$E_O=V_R+V_O \quad (4).$$

which is a constant value determined only by circuit constants. As the equation (4) is independent of Ip, the output voltage Eo at λ=1 is a highly reliable value.

In the rich region, as the electromotive force between two electrodes is reduced to the level of the exciting voltage as described in FIG. 6, the oxygen ions flow from the first electrode 222 part into the second electrode 223 part through the zirconia solid electrolyte 220, or flow in the opposite direction to the case of the lean region. The oxygen ion flow increase oxygen consistency in the second electrode 223 part. The oxygen ions are again neutralized in the second electrode 223 part to be converted into oxygen molecules and are burnt with the unburnt gas such as carbon monoxide which flows the exhaust gas atmosphere into the second electrode 223 part through the diffusion resistant body 224.

Therefore, the quantity of the oxygen ions transferred from the first electrode 222 part to the second electrode 223 part through the zirconia solid electrolyte 220 corresponds to the quantity of the unburnt gas flowing into the second electrode 223 part by diffusion. At that time, the pumping current in the electronic circuit is $Ip<0$.

As there is a certain relation between the consistency of the unburnt gas such as carbon monoxide and the excess air rate $\lambda$, equations (1)-(3) are effective in the rich region too, except that in the lean region, as $\lambda>1$, then $Ip>0$ and in the rich region, as $\lambda<1$, then $Ip<0$.

Then one example of a driving circuit of an A/F sensor is hereunder described with reference to FIG. 7. The same parts as in FIG. 5 are denoted by the same reference numerals as in FIG. 5.

The second electrode 223 is connected to the potential ground 227 (point Y) and controlled at a constant potential Vo by an amplifier 230. The potential of the first electrode 222 is controlled to be $(V_O+V_R)$ by an amplifier 225. Therefore, the potential difference between the first electrode 222 and the second electrode 223, or the exciting voltage $V_E$ is, $$V_E=(V_O+V_R)-V_O=V_R \quad (5)$$

and is controlled at a constant value regardless of the excess air rate $\lambda$.

In the lean region, the pumping current Ip flows from a point X to the real ground 226 through the resistor 229→ the zirconia solid electrolyte 220→ the floating ground point Y→ the amplifier 230.

In the rich region, the pumping current Ip flows from the floating ground point Y to the real ground 226 through the zirconia solid electrolyte 220→ the resistor 229→ the point X→ the amplifier 225.

At the theoretical A/F ($\lambda=1$), in the sensor $Ip=0$ as the principle, the output voltage Eo becomes $(V_R+V_O)$ as given by the equation (4).

Thus, with the embodiment of an A/F sensor of the present invention three conditions, i.e. $\lambda<1$, $\lambda=1$ and $\lambda>1$ can be detected continuously without switching the polarities between two electrodes and with a single source circuit.

Figure 7:
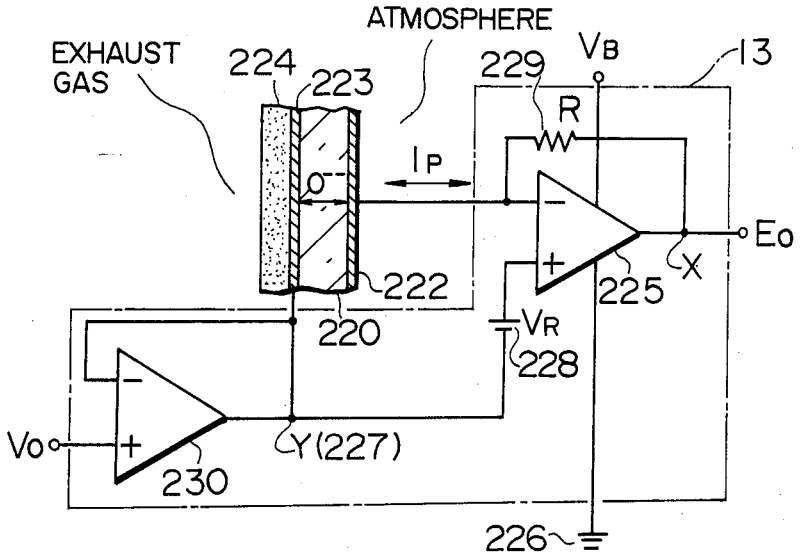
FIG. 7 shows an example of a driving circuit for the A/F sensor.
Figure 8:
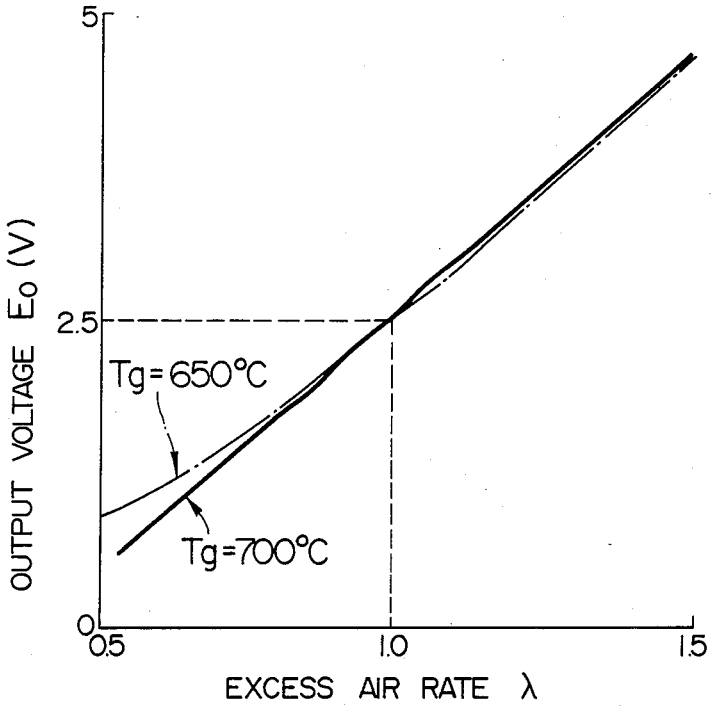
FIG. 8 shows output characteristics of the driving circuit.

Examples of the results obtained by the measurement with the constitution of the circuit shown in FIG. 7 are shown in FIG. 8. FIG. 8 shows the measured results when $V_O=2.275$ V and $V_R=0.225$ V. As shown by a solid line in the diagram, the A/F can be detected in the wide range from the rich region to the lean region continuously. It was also confirmed that the output voltage $E_O$ at the theoretical A/F ($\lambda=1$) was $V_O+V_R=2.5$ V which was predicted from the principle.

With this circuit, the A/F in the whole regions can be detected linearly and with high accuracy and smooth feed-back control A/F is facilitated in accordance with the conditions of an engine and a far more excellent control system in terms of exhaust gas countermeasure and fuel economy can be provided. Especially, significant improvement of fuel efficiency can be expected by that engine control in the lean region is facilitated and that linear feed-back control in the rich region is facilitated.

Figure 9:
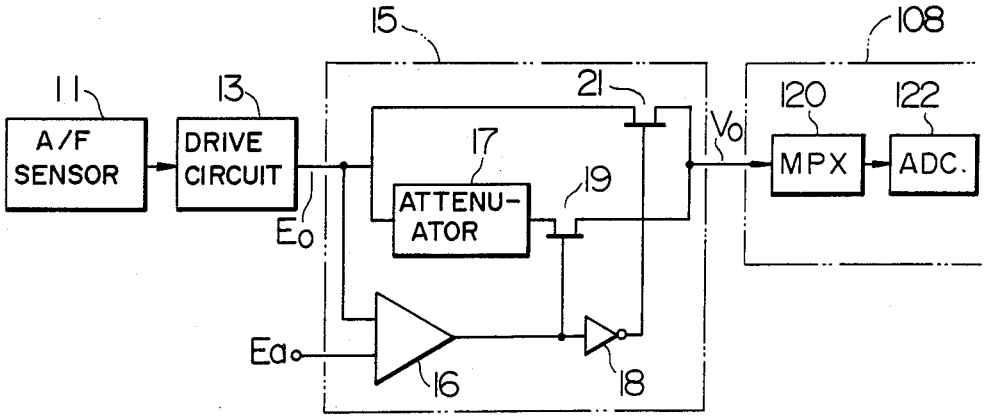
FIG. 9 is a diagram showing a configuration of an attneuator circuit.
Figure 10:
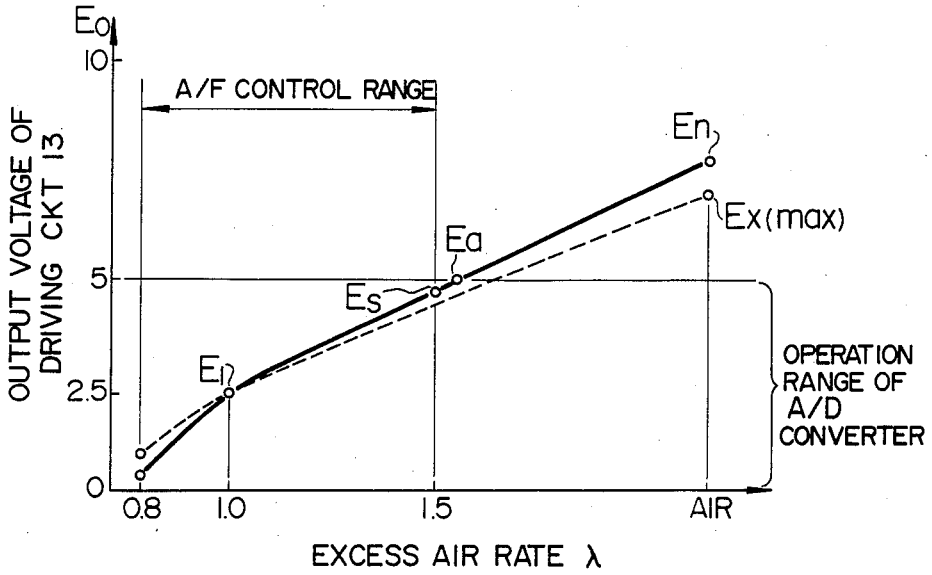
FIG. 10 is a diagram showing output characteristics of the A/F sensor in an initial state and a state under secular variations.

Now, a circuit for processing the output signal of this air-fuel ratio sensor 11 will be explaqned with reference to FIG. 9. As shown in FIG. 9, an output signal of the A/F sensor 11 is applied to the drive circuit 13, which in turn produces an output signal of the A/F sensor in linear relationship with the excess air rate $\lambda$ as described above. The output voltage $E_O$ of the drive circuit 13 is applied to the attenuator circuit 15. The attenuator circuit 15 has a comparator 16 for defining the control range of the air-fuel ratio of the control circuit 64, and has an input terminal thereof supplied with an output of the drive circuit 13, the other input terminal thereof being applied with a reference voltage $E_a$. The reference voltage $E_a$ corresponds to the voltage $E_a$ of FIG. 10 representing the output characteristics of the drive circuit 13 and stands at 5.0 V, for example. The attenuator circuit 15 further includes an attenuator 17 for protecting the A/D converter 122, transistor switches 19, 21 responsive to the output of the comparator 16, and an inverter 18. The output voltage $V_x$ of the attenuator circuit 15 is applied through a multiplexer 120 to the A/D converter 122, the output data of which is processed by the CPU 102. The injection amount of the fuel injection system 12 is controlled in response to the output signal of the CPU 102 thereby to control the air-fuel ratio.

The air-fuel ratio is generally controlled taking the economy, operability and prevention of the exhaust gas into consideration. Under the normal operation of the engine, the excess air rate $\lambda$ is controlled so as to be in a range between 0.8 and 1.5. The operating range (permissible input voltage range) of the A/D converter 122 is therefore also set so as to be in a range of 0 V to 5 V which coincids with an output voltage range of the drive circuit 13 corresponding to the range of excess air rate $\lambda$ from 0.8 to 1.5. In this way, by setting the range of the permissible input voltage of the A/D converter 122 so as to coincide with the output voltage range of the drive circuit 13 corresponding to the A/F control range under normal operation of the engine, the air-fuel ratio can be accurately detected.

When fuel is cut off, that is, fuel injection is stopped at a predetermined rate at the time of deceleration or the like, the air-fuel ratio becomes more than 1.5 and the output voltage of the drive circuit 13 deviates from the air-fuel control range as apparent from the characteristics of FIG. 10, while at the same time deviating from the permissible input voltage range of the A/D converter 122.

The comparator 16 is thus supplied with as a reference voltage a voltage $E_a$ (maximum value of the permissible input voltage of the A/D converter 122) which is slightly higher than the output voltage $E_s$, say, 4.0 V, of the drive circuit 13 corresponding to 1.5 of the excess air rate $\lambda$. When a voltage exceeding the maximum value $E_a$ of the permissible input voltage of the A/D converter 122 is delivered from the drive circuit 13 to the comparator 16, a signal is produced from the comparator 16, so that the transistor switch 19 is turned on while turning off the transistor switch 21 through the inverter 18 at the same time. As a consequence, the output of the drive circuit 13 is applied to the input/output circuit 108 through the attenuator 17 and the switch 19, with the result that the A/D converter is prevented from being applied with an input voltage which is out of the permissible range to thereby being protected. Assuming that the step-down ratio a of the attenuator 17 is ½, since the output of the drive circuit 13 is applied through the attenuator 17 to the A/D converter, the A/D converter 122 can detect also the output voltage in a range from 5.0 V to 10.0 V of the drive circuit 13.

As described above, in the initial stage of engine operation, that is, before being exposed to the exhaust gas, the drive circuit 13 has an output voltage characteristic against the excess air rate λ as shown by the solid line in FIG. 10. Under normal operation, the fuel injection from the injection valve 12 is controlled in such a manner that the excess air rate λ is between 0.8 and 1.5 under combustion. This control is effected by an electronic control unit 64. When the excess air rate λ is 1.0, the oxygen pump current fails to flow, and therefore the output voltage signal $E_1$ of the A/F sensor 11 is determined by the drive circuit 13 and is kept constant at, say, 2.5 V, regardless of the kinds of the A/F sensors. If the output voltage signal is controlled to $E_s=4.0$ V for the excess air rate λ of 1.5, on the other hand, the output characteristic of the drive circuit 13 assumes a curve as shown by the solid line in FIG. 10. In the case where the atmosphere is measured by a function representing this output characteristic curve, the output voltage assumes a maximum value $E_n$. The oxygen concentration in the atmosphere is constant at about 21%, and the oxygen concentration of the exhaust gas in the exhaust port 10 of the internal combustion engine is, at its maximum, the same oxygen concentration as the atmosphere but cannot increase any higher.

If the air-fuel ratio sensor 11 is exposed to the exhaust gas for a long time, due to thermal stress or due to the attachment of such elements as P, Zn, Fe or Pb in the exhaust gas to the sensor 11, the speed and amount of diffusion of the oxygen gas changes. Thus, the output voltage $E_O$ for same air fuel ratio changes with time, so that the output characteristic of the sensor 11 deviates from its initial condition, for instance, as shown by the dotted line in FIG. 10. Specifically, the output voltage $E_O$ for $\lambda=1$ remains at $E_1$ without any secular variations, while it assumes a lower (or higher) value on lean side and a higher (or lower) value on rich side for the same excess air rates. Thus, the output voltage $E_O$ from the drive circuit 13 fails to represent an accurate air fuel ratio.

According to the present invention, the characteristic cuver shown by the solid line in FIG. 10 is expressed by following functional equations (6a) and (6b) showing the characteristics of the lean side and the rich side, respectively. The excess air rate λ can be obtained by applying the detection voltage $E_O$ of the drive circuit 13 to these equations.

$$\lambda-1=0.333\ (Vx-E_1)\ (6a)\ \text{where } Vx>E_1.$$

$$\lambda-1=0.105\ (Vx-E_1)\ (6b),\ \text{where } Vx>E_1.$$

The maximum value $E_{x(max)}$ of the output voltage $E_O$ after secular variations is sampled, and the ratio $\alpha$ is determined between an amount of change in $E_{x(max)}$ against the voltage $E_1$ and an amount of change in the maximum value $E_n$ in initial state against the voltage $E_1$ as shown below in equation (7).

$$\alpha = \frac{E_n - E_l}{E_{x(max)} - E_l}. \quad (7)$$

The value $(V_x-E_1)$ in the equations (6a) and (6b) is multiplied by this value $\alpha$ so as to correct the functional equation of the characteristic curve in initial state, thereby obtaining the functional equations (8a) and (8b) of the characteristic curve after secular variations.

$$\lambda-1=\alpha\times0.333\ (V_x-E_1) \quad (8a)$$

$$\lambda-1=\alpha\times0.105\ (V_x-E_1) \quad (8b)$$

In order to obtain the functional equations (8a) and (8b) of the characteristic curve after secular variations, it is necessary to detect the maximum value $E_{x(max)}$ of the output voltage under secular variations as will be seen.

In the case where the fuel injection valve 12 closes and fails to supply fuel at such an engine operation condition as a deceleration state or the like, the exhaust port 10 is filled with the atmospheric air and so is the surroundings of the A/F sensor 11 a predetermined time later. As a result, the output of the A/F sensor 11 rises above the air-fuel ratio control range, to reach a maximum value to thereby cause so called a saturation state where the maximum output value is maintained for a predetermined length of time or longer. By sampling the output value of the drive circuit 13 under this saturation state, therefore, the sample value represents the maximum value $E_{x(max)}$.

In this way, the output value of the drive circuit 13 in the saturation state is sampled and this sampled value is written into the RAM 106. This sample value thus written replaces the sample value written at the previous saturation state. This written value $E_{x(max)}$ and the maximum value $V_n$ under initial state are used to determine the ratio $\alpha$ thereby to correct the characteristic curve.

Figure 11:
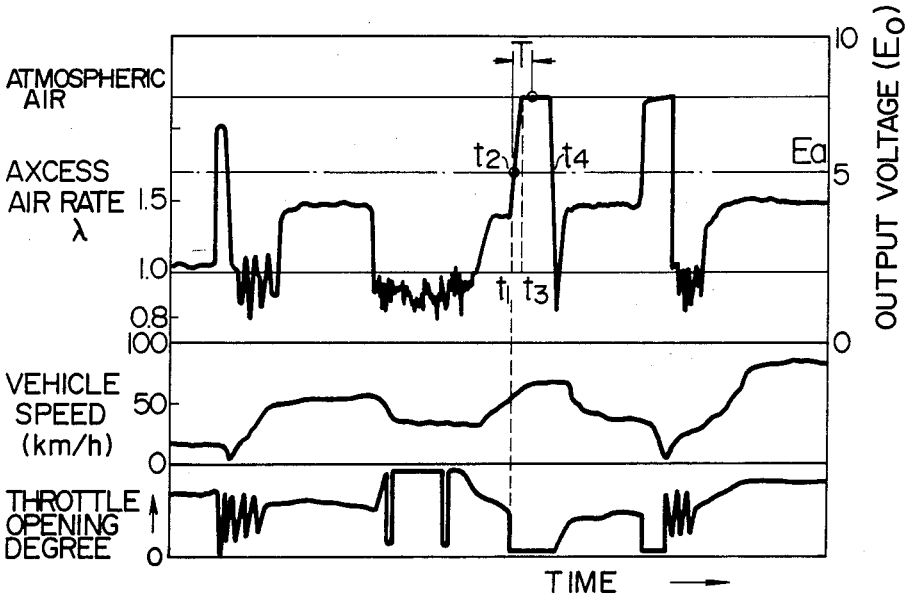
FIG. 11 is a graph showing the output values of the A/F sensor under the actual engine operating conditions.

FIG. 11 shows a change in excess air rate λ under actual operating conditions. As will be seen, if the throttle valve is closed in a deceleration state at a time point $t_1$, the excess air rate λ reaches the maximum value at a time point $t_3$. Specifically, even when the output value of the drive circuit 13 exceeds the permissible maximum input voltage $E_a$ of the A/D converter 122, the residual combustion gas exists in the exhaust port 10, and therefore the A/F sensor 11 is not considered to be filled with the atmospheric air. If the sampling is conducted upon a lapse of a predetermined time T after a time point $t_2$ where the output value exceedes the value $E_a$, on the other hand, the A/F sensor at this sampling time is always filled with the atmospheric air. An experiment shows that this time T is almost at least two seconds, or preferably 2.0 seconds.

Now, explanation will be made of a first embodiment of the air-fuel ratio control apparatus according to the present invention which conducts the air-fuel ratio control with reference to the flowchart of FIG. 12 under the assumption of the facts described above. This first embodiment concerns the case in which the invention is applied to an engine control system of fuel injection type shown in FIGS. 1 to 4.

Figure 12:
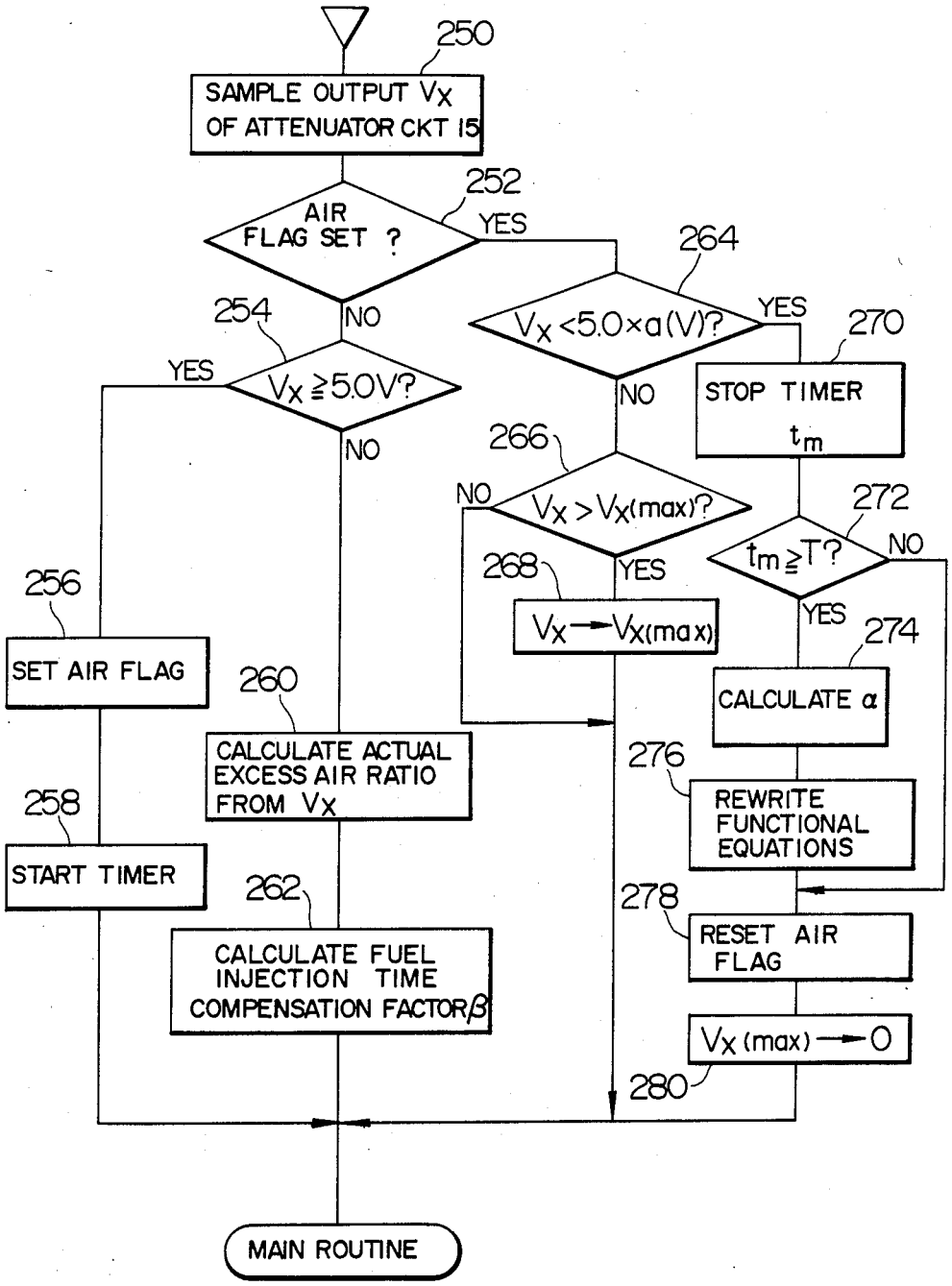
FIG. 12 is a flowchart of a first embodiment of the air-fuel ratio control apparatus according to the present invention.

The flowchart of FIG. 12 is executed in accordance with the program stored in the ROM 104 at a predetermined cycle or desirably at each one revolution of the crankshaft of the engine in response to the reference signal REF from the angle sensor 146. This flowchart may be executed alternatively at each half revolution of the crankshaft or at each lapse of a predetermined length of time.

When the engine starts and an interruption signal responsive to each one revolution of the crankshaft is applied to the CPU 102, step 250 is executed, at first.

In step 250, an output voltage $V_0$ of the attenuator circuit 15 to be applied to the multiplexer 120 and the A/D converter 122 through the A/F sensor 11, drive circuit 13 and the attenuator circuit 15 is sampled.

In step 252, it is checked whether an air flag is set in a predetermined area of the RAM 106. If it is not set, the process proceeds to step 254.

In step 254, it is checked whether the sample value $V_x$ of the output voltage $V_0$ of the attenuator circuit 15 obtained at step 250 is equal to or higher than the maximum value $E_a$ of the permissible input voltage range of the A/D converter 122, that is 5.0 V. If it is decided that $V_x$ is higher than or equal to 5.0 V, the process proceeds to step 256 for setting an air flag in the predetermined area of the RAM 106. This air flag indicates that the output voltage $V_0$ is equal to or exceeds the maximum value of the permissible input voltage range of the A/D converter 122. If $V_x$ exceeds 5.0 V, that is, if $E_0$ becomes higher than 5.0 V, the switch 19 in FIG. 9 is turned on and the switch 21 off, and therefore $V_x$ becomes $a \times E_0$ (V), in this case a is $\frac{1}{2}$.

The process then proceeds to step 258, wherein a timer such as a software timer in the RAM 106 is started. Then the process returns to the main routine. In the main routine, a well known engine control operation is executed.

If it is decided that $V_x$ is smaller than 5.0 V at step 254, by contrast, the process proceeds to step 260. In step 260, the sample value $V_x$ obtained at step 250 is substituted into one of the functional equations (8*a*) and (8*b*) stored in the RAM 106 thereby to calculate the actual excess air ratio $\lambda_x$. Namely, the actual excess air ratio is obtained by using the equations (8*a*) and (8*b*) when the $V_x$ is larger than 2.5 V and smaller than 2.5 V, respectively.

The process then proceeds to step 262, where the compensation factor $\beta$ for fuel injection time is calculated on the basis of the actual excess air ratio $\lambda_x$ obtained at step 260 and a target excess air ratio $\lambda_0$ as described below.

At first, a difference $e_x$ between the actual excess air ratio $\lambda_x$ obtained at step 260 and the target excess air ratio $\lambda_0$ is obtained and then the resulted difference $e_x = \lambda_x - \lambda_0$ is stored in the RAM 106.

Then, a difference $\Delta e_x$ between thus obtained difference $e_x$ and a previously obtained $e_{x-1}$ which is stored in the RAM is caclculated to thereby obtain a difference $\Delta e_x = e_x - e_{x-1}$.

Further, the difference $e_x$ is added to a total sum $$\left(\sum_{n=1}^{x-1} e_n\right)$$

of the differences $e_1, e_2 - - - e_{x-1}$ which have been obtained after start of the engine to thereby obtain a new total sum $$\sum_{n=1}^{x} e_n$$

and store it in the RAM.

The compensation factor $\beta$ is then calculated in accordance with a following equation on the basis of thus obtained values $e_x$, $\Delta e_x$ and $$\sum_{n=1}^{x} e_n.$$

$$\beta = Kp\, e_x + Ki \sum_{n=1}^{x} e_n + Kd\, \Delta e_x,$$

where Kp, Ki and Kd represent control constants for the engine.

The compensation factor $\beta$ for the fuel injection time thus obtained at step 262 is stored in a predetermined area of the RAM 106.

In the main routine, as mentioned above, the fuel injection time Ti for each intake stroke is calculated.

On the basis of the output voltage from the air flow rate sensor 24, the average air flow ratio $Q_A$ per one intake stroke of the cylinder is determined. A time (period) of basic fuel injection $T_P$ corresponding to the amount of fuel injection per one intake stroke is calculated on the basis of the average air flow rate $Q_A$, a coefficient K determined by the characteristics of the injector and so on and the engine speed N in accordance with the following equation.

$$T_p = K \frac{Q_A}{N}$$

The actual fuel injection time Ti is calculated from the basic fuel injection time $T_P$, the above-mentioned compensation factor $\beta$ and the various compensation factors $C_{oef}$ in accordance with the equation shown below.

$$T_i = T_P \cdot \beta \cdot C_{oef}$$

The digital data representing the fuel injection time $T_i$ determined in this way is applied to the injector control circuit 134, and a corresponding injection pulse is applied to the injector 12 through the AND gate 136 thereby to control the air-fuel ratio to the target value.

If step 252 decides that the air flag is set, the process proceeds to step 264. In step 264, it is checked whether the output voltage $V_x$ obtained at step 250 is less than 5.0 x a V or not, where a is the step down ratio of the attenuator 17*a* and is $\frac{1}{2}$ in this case. In other words, whether $V_x$ is lower than 2.5 V or not is checked.

As will be apparent from the subsequent steps 264 to 272, according to this embodiment, it is decided that the saturation state has occurred if the output voltage $E_0$ of the drive circuit 13 is kept at or above 5.0 V for at least a predetermined length of time T. During the period from the time point when $E_0$ has exceeded 5.0 V to the time point when it has decreased less than 5.0 V (that is, during the period from $t_2$ to $t_4$ in FIG. 11), the output of the attenuator circuit 15 is sampled, and the maximum one of the sampled values is used to determine the above-mentioned ratio as the maximum value $V_{x(max)}$.

If step 264 decides that $V_x$ is equal to or higher than 2.5 V, the process proceeds to step 266. In step 266, it is checked to see whether the present sample value $V_x$ is larger than the maximum sample value $V_{x(max)}$ among previously sampled values which is stored in predetermined areas of the RAM 106. If it is decided that $V_x$ is not larger than $V_{x(max)}$, the process returns to the main routine.

If the decision is that $V_x$ is larger than $V_{x(max)}$, on the other hand, the process proceeds to step 268. In step 268, the present sample value is stored as a new $V_{x(max)}$ in the predetermined area of the RAM 106 in place of the $V_{x(max)}$ that has been stored therein. At the end of step 268, the process is returned to the main routine. In this way, as long as it is decided that $V_x$ is not smaller than 5.0×a (V), the steps 266 and 268 are repeated so that the maximum sample value $V_{x(max)}$ which is maximum among all sample values sampled during the saturation state is stored in the predetermined area of RAM 106.

If step 264 decides that $V_x$ is smaller than 5.0×a (V), by contrast, at step 270 the soft timer is stopped temporarily.

Then, at step 272 the contents $t_m$ of the soft timer is read out and it is checked whether the content $t_m$ is not smaller than T (2 sec in this case) or not. If it is decided that the content $t_m$ is not smaller than T, it is decided that the saturation state has occurred. The soft timer is then reset, and at step 274 the above-mentioned ratio $\alpha$ is calculated. Namely, $E_{x(max)}=V_{x(max)}\times 1/a$ is substituted into the equation (7), and the ratio $\alpha$ is calculated from the equation shown below.

$$\alpha = \frac{E_n - E_l}{V_{x(max)} \times 1/a - E_l}$$

where the initial value $E_n$ of the maximum value is pregiven from the characteristic curve of FIG. 10, and is stored in the RAM.

The process then proceeds to step 276 where the ratio $\alpha$ in each of the equations (8*a*) and (8*b*) is replaced by thus obtained new ratio $\alpha$ thereby to rewrite the functional equations (8*a*) and (8*b*) stored in the RAM.

Next, at step 278 the air flag is reset and at step 280 the $V_{x(max)}$ stored in the RAM is reset to zero, and the process is returned to the main routine.

If at step 272 it is decided that $t_m$ is smaller than T, by contrast, it is decided that there exists no saturation state. As a result, the soft timer is reset, and the process proceeds to steps 278 and 280 without executing the step 274 nor 276.

As explained above, to the extent that the output voltage $E_0$ of the drive circuit 13 is lower than 5.0 V, the actual excess air ratio is calculated from the functional equations (8*a*) and (8*b*) based on the latest ratio $\alpha$ stored in the RAM. Then, this excess air ratio and a target excess air ratio are used to determine the compensation factor $\beta$, and thereafter the fuel injection time $T_i$ is determined.

If the output voltage $E_0$ of the drive circuit 13 is equal to or higher than 5.0 V, by contrast, it is checked whether the saturation state has occurred or not. If it is decided that the saturation state has occurred, the output characteristics of the drive circuit 13 is calibrated, and a functional equations representing the output characteristics thus calibrated are calculated and stored in the RAM.

In this way, even when the secular variations of the A/F sensor change the output characteristic thereof, a correct actual excess air ratio is obtained all the time.

Also, in the view of the fact that the decision whether the exhaust port is filled with the atmospheric air or not is made by directly reading the output voltage of the air-fuel ratio sensor, it is possible to accurately detect the output value of the A/F sensor under the condition where the exhaust port is filled with the atmospheric air. Thus, accurate calibration of the output characteristic of the A/F sensor can be performed.

In the foregoing embodiment, the time T for determining a saturation state is kept constant. This time T, however, may be variable in accordance with the engine operating conditions. If the time T is set shorter with the increase in engine speed, for example, the saturation state can be detected earlier. Thus, a processing time required for calibrating the output characteristic of the A/F sensor can be made shorter.

Now, the above-explanation was made about a case where the output characteristics of the A/F sensor in initial state of FIG. 10 is represented by the two equations (6*a*) and (6*b*). However, the output characteristics of the A/F sensor in initial state can be represented by following one equation (9) instead of the equations (6*a*) and (6*b*). Namely, this equation (9) shows the output characteristics of the A/F sensor on both lean and rich sides.

$$\lambda-1=-0.005(V_x-E_1)^4+0.006(V_x-E_1)^3+0.084(V_x-E_1)^2+0.211(V_x-E_1) \quad (9)$$

When using this equation as the functional equation of the characteristic curve in initial state, the functional equations after secular variations can be represented by following equation (10).

$$\lambda-1=-\alpha^4\cdot 0.005(V_x-E_1)^4+\alpha^3\cdot 0.006(V_x-E_1)^3+\alpha^2\cdot 0.084(V_x-E_1)^2+\alpha\cdot 0.211(V_x-E_1) \quad (10)$$

The actual excess air ratio $\lambda$ can be obtained from this equation (10) at step 260 of FIG. 12.

Explanation will be made of an air-fuel ratio control apparatus according to another embodiment of the present invention as applied to an electronically-controlled carburetor system.

Figure 13:
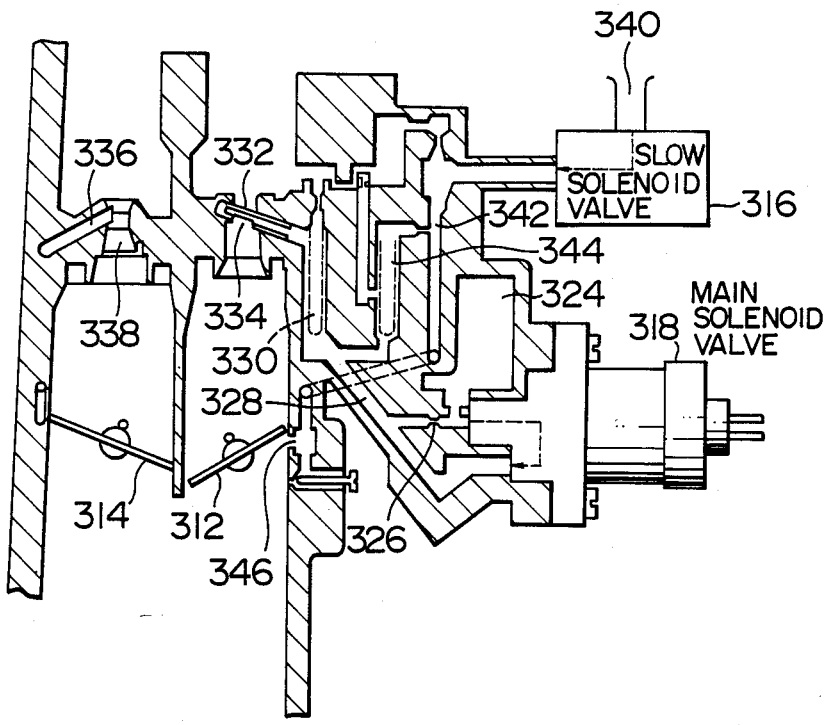
FIG. 13 is a cross-sectional view of a throttle chamber of an engine with an electronically-controlled carburetor system.
Figure 14:
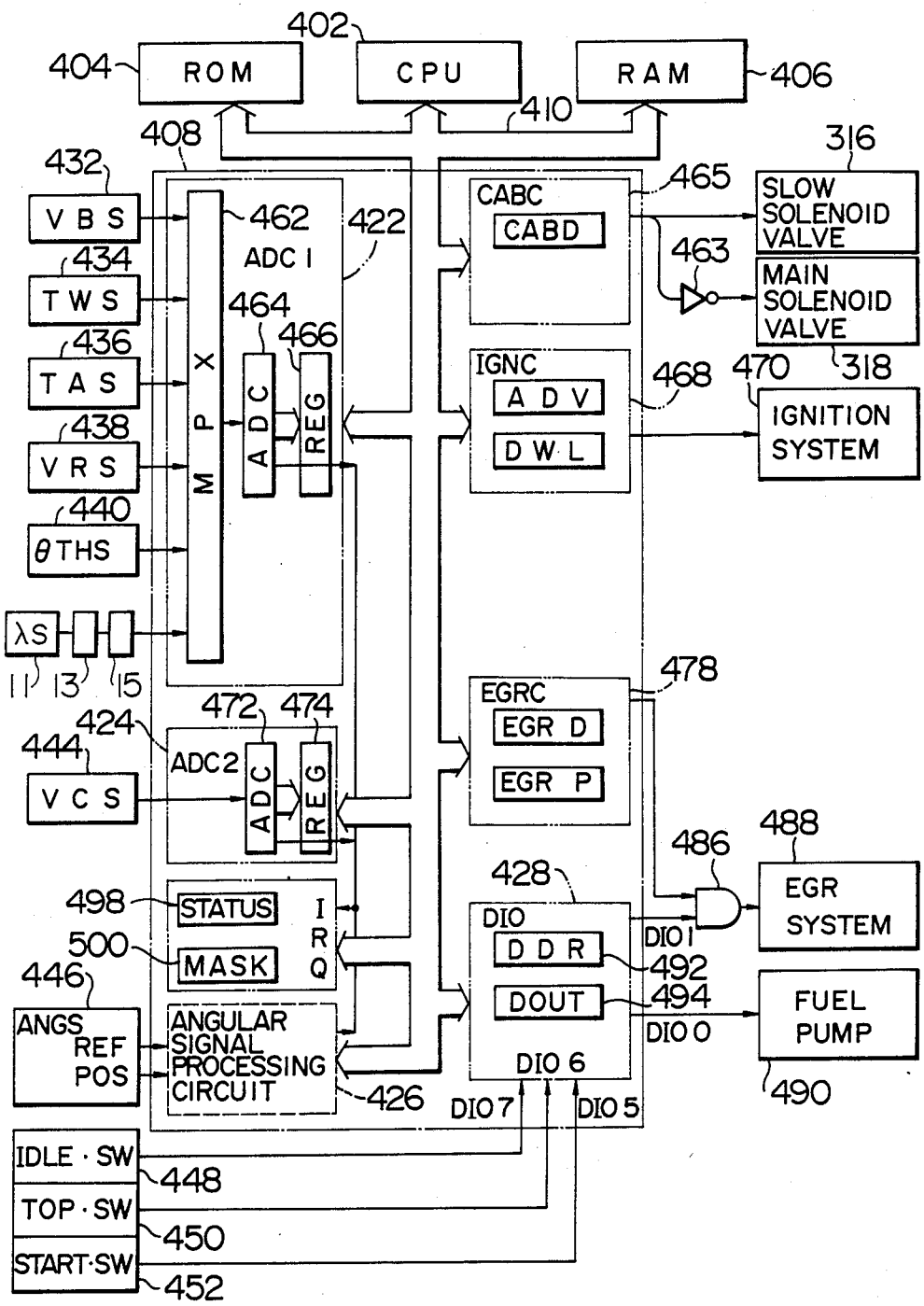
FIG. 14 shows a whole engine control system for an electronically controlled carburetor.

This embodiment is an electronically controlled carburetor system, of which the control unit for the whole engine system is shown in FIGS. 13 and 14. FIG. 13 is a cross-sectional diagram of a typical example of a throttle chamber in the electronically controlled carburetor system to which the second embodiment is applied.

Various solenoid valves are provided around the throttle chamber for controlling a fuel quantity and a bypass air flow supplied to the throttle chamber, as will be described below.

Opening of a throttle valve 312 for a low speed operation is controlled by an acceleration pedal (not shown), whereby air flow supplied to individual cylinders of the engine from an air cleaner (not shown) is controlled. When the air flow passing through a Venturi 334 for the low speed operation is increased as the result of the increased opening of the throttle valve 312, a throttle valve 314 for a high speed operation is opened through a diaphragm device (not shown) in dependence on a negative pressure produced at the Venturi for the low speed operation, resulting in a decreased air flow resistance which would otherwise be increased due to the increased intake air flow.

The quantity of air flow fed to the engine cylinders under the control of the throttle valves 312 and 314 is detected by a negative pressure sensor (not shown) and converted into a corresponding analog signal. In dependence on the analog signal thus produced as well as other signals available from other sensors which will be described hereinafter, the opening degrees of various solenoid valves 316, 318 and 322 shown in FIG. 13 are controlled.

Next, description will be made on the control of the fuel supply. The fuel fed from a fuel tank through a conduit 324 is introduced into a conduit 328 through a main jet orifice 326. Additionally, fuel is introduced to the conduit 328 through a main solenoid valve 318. Consequently, the fuel quantity fed to the conduit 328 is increased as the opening degree of the main solenoid valve 318 is increased. Fuel is then fed to a main emulsion tube 330 to be mixed with air and supplied to the Venturi 334 through a main nozzle 332. At the time when the throttle valve 314 for high speed operation is opened, fuel is additionally fed to a Venturi 338 through a nozzle 336. On the other hand, a slow solenoid valve (or idle solenoid valve) 316 is controlled simultaneously with the main solenoid valve 318, whereby air supplied from the air cleaner is introduced into a conduit 342, through an inlet port 340. Fuel fed to the conduit 328 is also supplied to the conduit or passage 342 through a slow emulsion tube 344. Consequently, the quantity of fuel supplied to the conduit 342 is decreased as the quantity of air supplied through the slow solenoid valve 316 is increased. The mixture of air and fuel produced in the conduit 342 is then supplied to the throttle chamber through an opening 346 which is also referred to as the slow hole.

The slow solenoid valve 316 cooperates with the main solenoid valve 318 to control the air-fuel ratio.

FIG. 14 is a schematic diagram showing a general arrangement of a control system for the carburator system of FIG. 13. The control system includes a central processing unit (hereinafter referred to as CPU) 402, a read-only memory (hereinafter referred to as ROM) 404, a random access memory (hereinafter referred to as RAM) 406, and an input/output interface circuit 408. The CPU 402 performs arithmetic operations for input data from the input/output circuit 408 in accordance with various programs stored in ROM 404 and feeds the results of arithmetic operation back to the input/output circuit 408. Temporal data storage as required for executing the arithmetic operations is accomplished by using the RAM 406. Various data transfers or exchanges among the CPU 402, ROM 404, RAM 406 and the input/output circuit 408 are realized through a bus line 410 composed of a data bus, a control bus and an address bus.

The input/output interface circuit 408 includes input means constituted by a first analog-to-digital converter 422 (hereinafter referred to as ADC1), a second analog-to-digital converter 424 (hereinafter referred to as ADC2), an angular signal processing circuit 426, and a discrete input/output circuit 428 (hereinafter referred to as DIO) for inputting or outputting a single-bit information.

The ADCl 422 includes a multiplexer 462 (hereinafter referred to as MPX) which has input terminals applied with output signals from a battery voltage detecting sensor 432 (hereinafter referred to as VBS), a sensor 434 for detecting temperature of cooling water (hereinafter referred to as TWS), an ambient temperature sensor 436 (hereinafter referred to as TAS), a regulatedvoltage generator 438 (hereinafter referred to as VRS), a sensor 440 for detecting a throttle angle (hereinafter referred to as $\theta$THS) and an air-fuel ratio sensor 11 (hereinafter referred to as $\lambda$S). The multiplexer or MPX 462 selects one of the input signals to supply it to an analog-to-digital converter circuit 464 (hereinafter referred to as ADC). A digital signal output from the ADC 464 is held by a register 466 (hereinafter referred to as REG).

The output signal from a negative pressure sensor 444 (hereinafter referred to as VCS) is supplied to the input of ADC2 424 to be converted into a digital signal through an analog-to-digital converter circuit (hereinafter referred to as ADC) 472. The digital signal output from the ADC 472 is set in a register (hereinafter referred to as REG) 474.

An angle sensor 446 (hereinafter termed ANGS) is adapted to produce a signal representative of a standard or reference crank angle, e.g. of 180° (this signal will be hereinafter termed REF signal) and a signal representative of a minute crank angle (e.g. 0.5°) which signal will be hereinafter referred to as POS signal. Both of the signals REF and POS are applied to the angular signal processing circuit 426 to be shaped.

The discrete input/output circuit or DIO 428 has inputs connected to an idle switch 448 (hereinafter referred to as IDLE-SW), a top-gear switch 450 (hereinafter termed TOP-SW) and a starter switch 452 (hereinafter referred to as START-SW).

Next, description will be made on a pulse output circuit as well as objects or functions to be controlled on the basis of the results of arithmetic operations executed by CPU 402. A air-fuel ratio control device 465 (hereinafter referred to as CABC) serves to vary the duty cycle of a pulse signal supplied to the slow solenoid valve 316 and the main solenoid valve 318 for the control thereof. Since increasing in the duty cycle of the pulse signal through control by CABC 465 has to involve decreasing in the fuel supply quantity through the main solenoid valve 318, the output signal from CABC is applied to the main solenoid valve 318 through an inverter 463. On the other hand, the fuel supply quantity controlled through the through the slow solenoid valve 316 is increased, as the duty cycle of the pulse signal produced from the CABC 465 is increased. The CABC 465 includes a register (hereinafter referred to as CABD) for setting therein the duty cycle of the pulse signal. Data for the duty cycle to be loaded in the register CABD is available from the CPU 402.

An ignition pulse generator circuit 468 (hereinafter referred to as IGNC) is provided with a register (hereinafter referred to as ADV) for setting therein ignition timing data and a register (hereinafter referred to as DWL) for controlling a duration of the primary current flowing through the ignition coil. Data for these controls are available from the CPU 402. The output pulse from the IGNC 468 is applied to the ignition system denoted by 470 in FIG. 14. The ignition system 470 is implemented in such arrangement as described hereinbefore by referring to FIG. 2. Accordingly, the output pulse from the IGNC 468 is applied to the input of the amplifier circuit 68 shown in FIG. 2.

A pulse generator circuit 478 (hereinafter referred to as EGRC) for producing a pulse signal to control the quantity of exhaust gas to be recirculated (EGR) includes a register (hereinafter termed EGRP) for setting the pulse repetition period and a register (hereinafter termed EGRD) for setting the duty cycle of the pulse signal.

When the output signal DIO1 from the DIO 428 is at a level "H", an AND gate 486 is made conductive to control the EGR system 488, a fundamental construction of which is illustrated in FIG. 3.

The DIO 428 is an input/output circuit for a single bit signal as described hereinbefore and includes to this end a register 492 (hereinafter referred to as DDR) for holding data to determine the output or input operation, and a register 494 (hereinafter referred to as DOUT) for holding data to be output. The DIO 428 produces an output signal DI00 for controlling the fuel pump 490.

The second embodiment of an air-fuel ratio control apparatus of the invention in the engine control system using an electronically controlled carburetor will be described with reference to FIGS. 13 and 14.

The A/F sensor, drive circuit 13 and the attenuator circuit 15 used in this embodiment are identical in constructions and functions to those shown in the first embodiment, so that the output of the A/F sensor 11 is applied through the drive circuit 13 and the attenuator circuit 15 to the input/output circuit 408 in the same manner as in the first embodiment.

Figure 15:
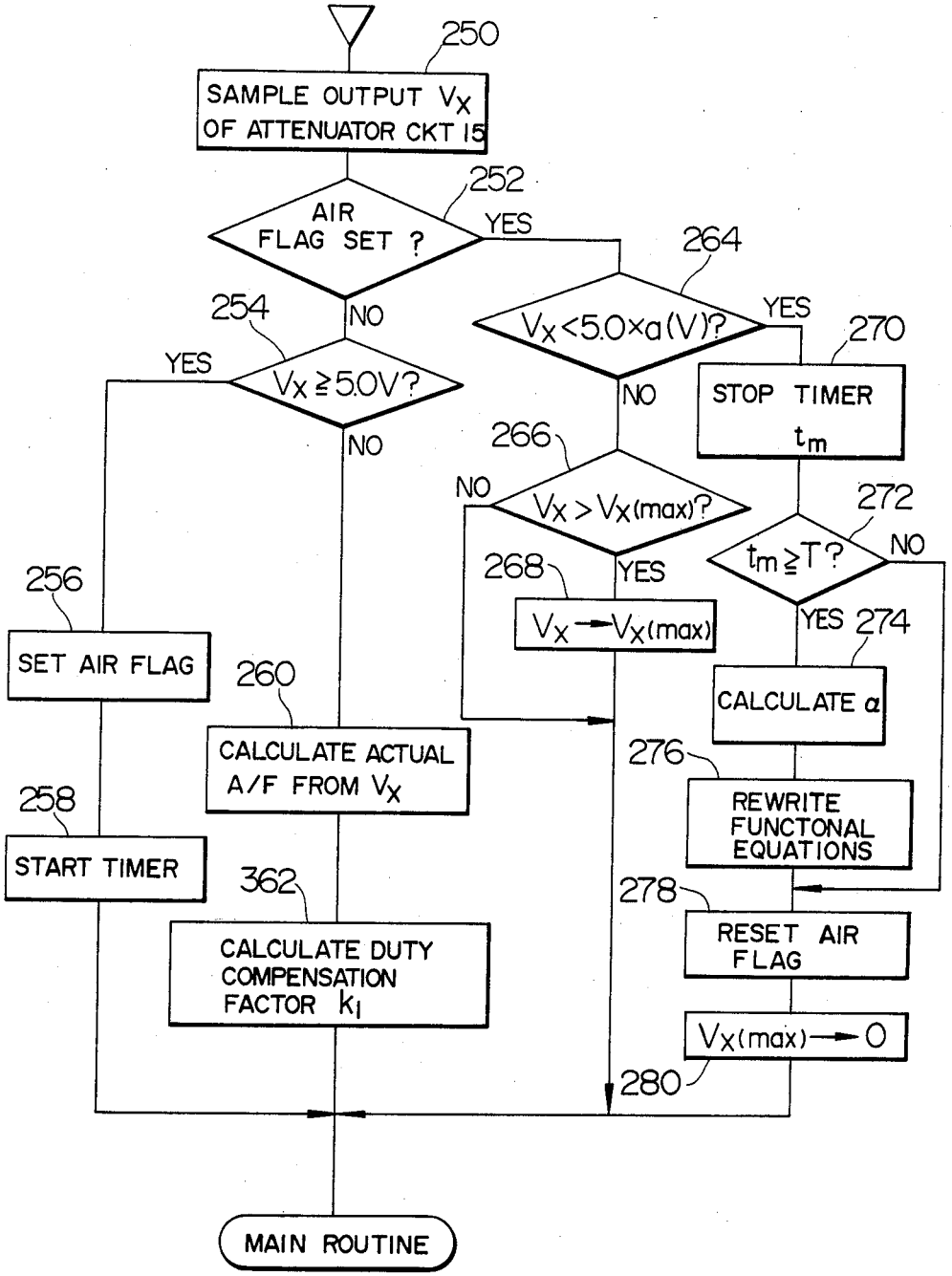
FIG. 15 is a flowchart of a second embodiment of the present invention.

The operation of the air-fuel ratio control apparatus in this embodiment will be explained with reference to the flowchart of FIG. 15. The flowchart of FIG. 15 is the same as that of FIG. 12 for the first embodiment except for the step 362, so that explanation will be made only about step 362.

Step 362 calculates the compensation factor $k_1$ for the on-duty of the slow solenoid valve 316 almost in the same manner as step 262 of FIG. 12 on the basis of the target excess air ratio and the actual excess air ratio determined in step 260 in accordance with the following equation.

$$k_1 = K_p' e_x + K_i' \sum_{n=1}^{x} e_n + K_d' \Delta e_x,$$

where $K_P'$, $K_i'$ and $K_d'$ represent control factors and $e_x$, $$\sum_{n=1}^{x} e_n$$

and $\Delta e_x$ are same values as those obtained at step 262.

In the main routine, the on-duty $D_{on}$ of the slow solenoid valve 316 is read from a well-known three-dimensional map stored in the RAM 406 on the basis of the engine speed N, and magnitude of suction vacuum (negative pressure) $V_c$.

Further, the compensation factor $k_2$ for the on-duty depending on the temperature of cooling water is read from the well-known map in the RAM.

On the basis of the on-duty $D_{on}$ read as above, the compensation factor $k_1$ obtained in step 362, and the compensation factor $k_2$, a compensated on-duty $k_1.k_2$. $D_{on}$ is calculated and it is set in the register CABD. As a result, a pulse based on this compensated on-duty is applied to the slow solenoid valve 316 on one hand, and also applied to the main solenoid valve 318 through the inverter 463 on the other hand thereby to control the air-fuel ratio to the target value.

As described above, it is decided also in this embodiment whether the exhaust port is filled with the atmospheric air or not by directly reading the output voltage of the A/F sensor. Therefore the output of the A/F sensor in a state where the exhaust port is filled with the atmospheric air can be accurately detected, thus making it possible to calibrate the output characteristic of the A/F sensor accurately. As a consequence, even if the output characteristic of the A/F sensor changes under secular variations thereof an accurate actual air-fuel ratio is always obtained, thereby properly controlling the air-fuel ratio.

Further, according to the present invention, an A/F sensor that can detect the air-fuel ratio on both lean and rich sides is used, and therefore the air-fuel ratio control is possible substantially over the entire range of operating conditions.

Furthermore, according to the above mentioned embodiments of the present invention, functional equations representing the output characteristics of the A/F sensor stored in the RAM is corrected in accordance with the secular variations thereof. Alternatively, instead of storing the equations in the RAM and correcting it, the output characteristic data in initial state of the A/F sensor may be stored in the RAM and this output characteristic data may be rewritten by multiplying it by the ratio $\alpha$ to thereby obtain correct output characteristic date after secular vitiations to store in the RAM. In this case, the actual excess air ratio can be obtained from the output value of the A/F sensor by referring the corrected data stored in the RAM.

Now, in this embodiment, it is also possible to obtain the actual excess air rate at step 260 by using the functional equation (10) instead of the equations (8*a*) and (8*b*).

We claim:

1. An air-fuel ratio control apparatus for an internal combustion engine, comprising:

a plurality of sensors for detecting an operating condition of the engine;

an air-fuel ratio sensor disposed in the exhaust system of the internal combustion engine and having such an output characteristic that an output electrical signal correlated with the excess air ratio of the ambient gas surrounding it is produced therefrom and when the ambient gas is filled with air alone, a maximum output signal is produced therefrom;

sampling means for sampling the maximum output of said air-fuel ratio sensor when it is decided that the output of said air-fuel ratio sensor is maintained above a predetermined value for at least a predetermined length of time;

memory means for storing sample values of the maximum output of said sampling means and replacing the preceding sample value with the present sample value when a new maximum output thereof is sampled each time of said decision;

calibration means for calibrating the output characteristic of said air-fuel ratio sensor by the new sample value;

means for determining the actual excess air ratio from the output value of said air-fuel ratio sensor on the basis of the calibrated output characteristic of said air-fuel ratio sensor;

means for determining the compensation factor of the excess air ratio from the actual excess air ratio thus obtained and a target excess air ratio;

arithmetic means for determining a control value for attaining a desired air-fuel ratio of a mixture to be supplied to the combustion chamber on the basis of the outputs of said sensors and said excess air ratio compensation factor;

a drive circuit for producing a control signal in response to the output of said arithmetic means; and air-fuel ratio control means for controlling the air-fuel ratio of the mixture in accordance with the output of said drive circuit thereby to attain the desired excess air ratio.

2. An air-fuel ratio control apparatus according to claim 1, wherein said air-fuel ratio control means is fuel injection valve means for injecting fuel for a fuel injection period represented by the output of said drive circuit in response thereto, and said arithmetic means determines a fuel injection period for one suction stroke of the combustion chamber as said control value on the basis of the outputs of said sensors and said excess air ratio compensation factor.

3. An air-fuel ratio control apparatus according to claim 2, wherein said sampling means samples the output of said air-fuel ratio sensor at intervals of a predetermined rotational angle of the crankshaft of said engine, and when it is decided that the output of said air-fuel ratio sensor is maintained at not less than said predetermined value for at least said predetermined length of time, the maximum value of the sampling values which have been sampled from a time point when the output of said air-fuel ratio sensor exceeds said predetermined value to a time point when said output is reduced below said predetermined value is applied to said memory means as said maximum output.

4. An air-fuel ratio control apparatus according to claim 2, further comprising attenuator means for attenuating the output of said air-fuel ratio sensor, said attenuator means applying the output of said air-fuel ratio sensor to said sampling means without attenuating it when the output value of said air-fuel ratio sensor is less than said predetermined value, and applying the output of said air-fuel ratio sensor to said sampling means after attenuating it when the output value of said air-fuel ratio sensor is not smaller than said predetermined value, said predetermined value being an output value of said air-fuel ratio sensor corresponding to the maximum value in the air-fuel ratio control range of the engine.

5. An air-fuel ratio control apparatus according to claim 2, wherein said calibration means calculates the ratio of the difference between the maximum output value in the initial state of said air-fuel ratio sensor and a predetermined reference output value to the difference between the replaced new sample value stored in said memory means and said predetermined reference output value, and the output characteristic of said air-fuel ratio sensor is calibrated on the basis of said ratio of the differences.

6. An air-fuel ratio control apparatus according to claim 2, wherein said air-fuel ratio sensor is capable of detecting the excess air ratio on both the lean and rich sides with respect to the theoretical air-fuel ratio, and said calibration means calibrates the output characteristics on both the lean and rich sides of said air-fuel ratio sensor.

7. An air-fuel ratio control apparatus according to claim 1, wherein said air-fuel ratio control means is air-solenoid valve means provided in a carburetor of the engine, and said arithmetic means determines an on-duty of said air solenoid valve means on the basis of the outputs of said sensors and said excess air ratio compensation factor.

8. An air-fuel ratio control apparatus according to claim 7, wherein said sampling means samples the output of said air-fuel ratio sensor at intervals of a predetermined rotational angle of the crankshaft of said engine, and when it is decided that the output of said air-fuel ratio sensor is maintained for not less than said predetermined length of time at not less than said predetermined value, the maximum value of the sample values which have been sampled from a time point when the output of said air-fuel ratio sensor reaches a value not less than said predetermined value to a time point when said output of said air-fuel ratio sensor is reduced below said predetermined value is applied to said memory means as said maximum output.

9. An air-fuel ratio control apparatus according to claim 7, further comprising attenuator means for attenuating the output of said air-fuel ratio sensor, said attenuator means applying the output of said air-fuel ratio sensor to said sampling means without being attenuating it when the output value of said air-fuel ratio sensor is less than said predetermined value, and applying the output of said air-fuel ratio sensor to said sampling means after attenuating it when said output value of said air-fuel ratio sensor is not less than said predetermined value, said predetermined value being an output value of said air-fuel ratio sensor corresponding to the maximum value in the air-fuel ratio control range of the engine.

10. An air-fuel ratio control apparatus according to claim 7, wherein said calibration means calculates the ratio of the difference between the maximum output value in the initial state of said air-fuel ratio sensor and a predetermined reference output value to the difference between the replaced new sample value stored in said memory means and said predetermined reference output value, and the output characteristic of said air-fuel ratio sensor is calibrated on the basis of said ratio of the differences.

11. An air-fuel ratio control apparatus according to claim 7, wherein said air-fuel ratio sensor is capable of detecting the excess air ratio on both the lean and rich sides with respect to a theoretical air-fuel ratio, and said calibration means calibrates the output characteristics on both the lean and rich sides of said air-fuel ratio sensor.

* * * * *